US008894060B2

(12) United States Patent
Takamori

(10) Patent No.: US 8,894,060 B2
(45) Date of Patent: Nov. 25, 2014

(54) MEDIUM FEEDING APPARATUS

(71) Applicant: PFU Limited, Ishikawa (JP)

(72) Inventor: Masaya Takamori, Ishikawa (JP)

(73) Assignee: PFU Limited, Ishikawa (JP)

( * ) Notice: Subject to any disclaimer, the term of this patent is extended or adjusted under 35 U.S.C. 154(b) by 0 days.

(21) Appl. No.: 14/067,890

(22) Filed: Oct. 30, 2013

(65) Prior Publication Data

US 2014/0284869 A1 Sep. 25, 2014

(30) Foreign Application Priority Data

Mar. 19, 2013 (JP) ..... 2013-056520

(51) Int. Cl.

| | |
|---|---|
| ***B65H 5/00*** | (2006.01) |
| ***B65H 7/02*** | (2006.01) |
| ***B65H 3/06*** | (2006.01) |
| ***B65H 5/06*** | (2006.01) |

(52) U.S. Cl.

CPC ..... *B65H 5/062* (2013.01); *B65H 7/02* (2013.01); *B65H 3/0615* (2013.01)

USPC ..... 271/10.11; 271/273

(58) Field of Classification Search

CPC ..... B65H 5/062

USPC ..... 271/273, 274, 258.01, 259, 121, 124, 271/125; 399/21, 124

See application file for complete search history.

(56) References Cited

U.S. PATENT DOCUMENTS

| | | | | |
|---|---|---|---|---|
| 7,267,338 | B2 | 9/2007 | Kuwata et al. | |
| 7,448,619 | B2 | 11/2008 | Kuwata et al. | |
| 7,731,188 | B2 * | 6/2010 | deJong et al. | 271/273 |
| 8,186,674 | B2 * | 5/2012 | Fujita | 271/259 |
| 2007/0246879 | A1 * | 10/2007 | Sagawa et al. | 271/12 |
| 2010/0191368 | A1 * | 7/2010 | Celeste et al. | 700/230 |
| 2010/0258999 | A1 * | 10/2010 | Degruchy | 271/273 |
| 2011/0210502 | A1 * | 9/2011 | Fujita | 271/258.01 |

FOREIGN PATENT DOCUMENTS

| | | | |
|---|---|---|---|
| JP | 2003-302876 | A | 10/2003 |
| JP | 2005-010575 | A | 1/2005 |
| JP | 2007-053532 | A | 3/2007 |

* cited by examiner

*Primary Examiner* — Jeremy R Severson

(74) *Attorney, Agent, or Firm* — McDermott Will & Emery LLP

(57) ABSTRACT

A medium feeding apparatus includes an opening unit (a lock shaft, a lock arm, a hopper, a link member, and a rotating member) that performs an opening operation in a direction in which rollers coming into press contact with each other on a conveying path for a medium are separated from each other when a conveyance error of the medium occurs. An error release operation control unit of a controller controls the opening unit by switching whether an opening operation is performed to the degree of opening in which a conveying roller and a driven roller are separated from each other or an opening operation is performed to the degree of opening in which a separating roller and a braking roller are separated from each other, according to an entering distance of the medium on the conveying path.

6 Claims, 10 Drawing Sheets

MEDIUM FEEDING APPARATUS

CROSS-REFERENCE TO RELATED APPLICATION

This application is based upon and claims the benefit of priority from Japanese Patent Application No. 2013-056520, filed on Mar. 19, 2013, the entire contents of which are incorporated herein by reference.

BACKGROUND OF THE INVENTION

1. Field of the Invention

The present invention relates to a medium feeding apparatus.

2. Description of the Related Art

When a conveyance error, such as a jam or a double-feed, occurs in a medium feeding apparatus that separates and feeds media one by one from a plurality of stacked sheet-like media, recovery work for recovering the error is performed by an operator. In the recovery work, the operator opens a cover of a portion where the error occurs, removes a medium causing the error from the apparatus, closes the cover, and sets a medium again. In the past, techniques that automatically open a cover of a portion where an error occurs at the time of the occurrence of the conveyance error have been known to improve the efficiency of this recovery work (for example, see Japanese Laid-open Patent Publication No. 2003-302876 and Japanese Laid-open Patent Publication No. 2007-53532).

A medium feeding apparatus in the related art had room for further improvement in terms of the efficiency of recovery work at the time of the occurrence of a conveyance error.

SUMMARY OF THE INVENTION

It is an object of the present invention to at least partially solve the problems in the conventional technology.

According to an aspect of the present invention, a medium feeding apparatus includes: a separating roller that feeds a medium in a conveying direction; a braking unit that is disposed so as to come into press contact with the separating roller and applies a predetermined conveying load to the medium entering a gap between the separating roller and the braking unit; a conveying roller that is disposed on a downstream side of the separating roller in the conveying direction; a driven roller that is disposed so as to come into press contact with the conveying roller; and an opening unit that performs an opening operation in a direction in which members coming into press contact with each other on a conveying path for the medium are separated from each other when a conveyance error of the medium occurs. The opening unit is configured to switch whether to perform a first opening operation to a degree of opening in which the conveying roller and the driven roller are separated from each other or to perform a second opening operation to a degree of opening in which the separating roller and the braking unit are separated from each other, according to an entering distance of the medium on the conveying path.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
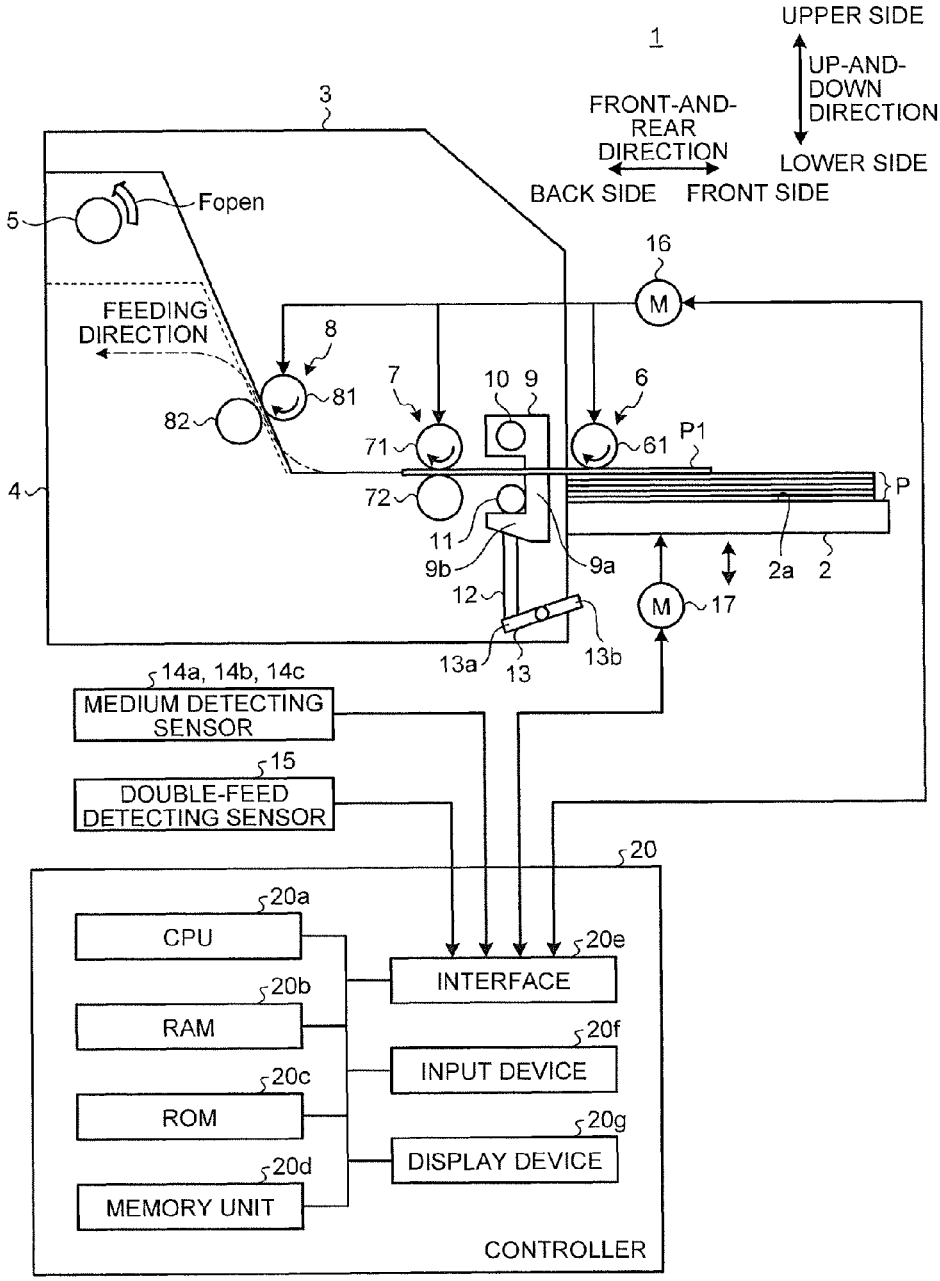
FIG. 1 is a diagram for explaining the hardware configuration of a medium feeding apparatus according to a first embodiment of the invention.

A medium feeding apparatus according to embodiments of the invention will be explained below with reference to the drawings. Meanwhile, the same portions or corresponding portions are denoted by the same reference numerals, and the explanation thereof will not be repeated.

First Embodiment

Figure 2:
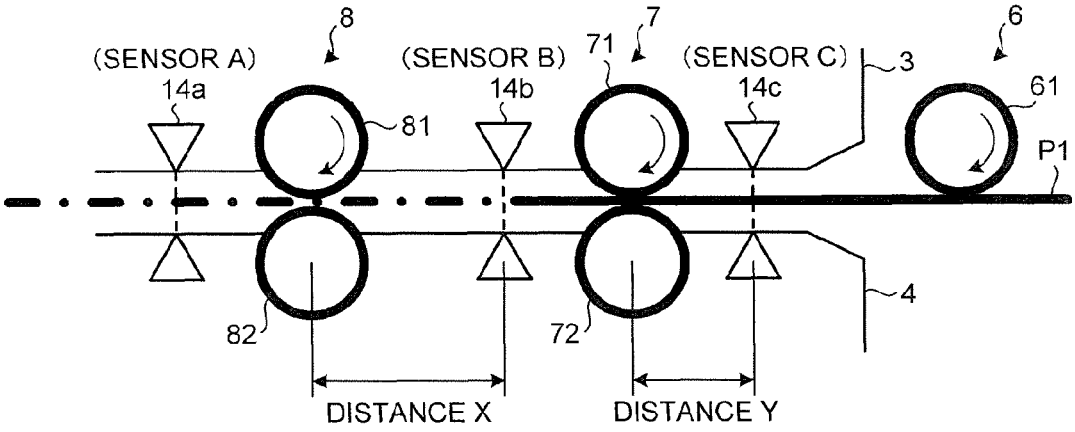
FIG. 2 is an enlarged schematic diagram of components provided near a conveying path of FIG. 1.
Figure 3:
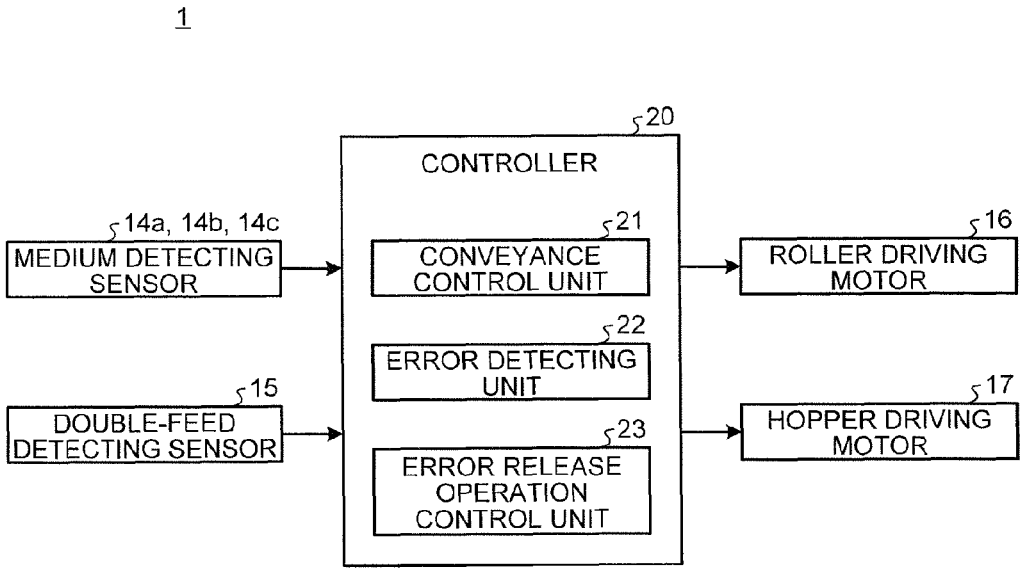
FIG. 3 is a functional block diagram of the medium feeding apparatus shown in FIG. 1.

A first embodiment will be explained with reference to FIGS. 1 to 5. First, the configuration of a medium feeding apparatus according to the first embodiment will be explained with reference to FIGS. 1 to 3. FIG. 1 is a diagram for explaining the hardware configuration of a medium feeding apparatus according to the first embodiment of the invention, and FIG. 2 is an enlarged schematic diagram of components provided near a conveying path of FIG. 1. FIG. 3 is a functional block diagram of the medium feeding apparatus shown in FIG. 1.

As shown in FIG. 1, a medium feeding apparatus 1 according to this embodiment is an apparatus that separates and feeds media P1 to be conveyed one by one from a plurality of media P stacked on a hopper 2 (medium loading unit). The medium feeding apparatus 1 is applied to an automatic document feeder (ADF) that is mounted on, for example, image readers, such as an image scanner, a copy machine, a facsimile, and a character recognition device, or an image forming apparatus such as a printer. Media P and P1 include, for example, sheet-like objects to be read, such as a document and a business card, and sheet-like recording media, such as a print sheet and a sheet.

Meanwhile, in the following explanation, an up-and-down direction and a left-and-right direction in FIG. 1 are explained as an up-and-down direction and a front-and-rear direction of the medium feeding apparatus 1; the upper side, the lower side, the right side, and the left side in FIG. 1 are explained as the upper side, the lower side, the front side, and the back side of the medium feeding apparatus 1, respectively; and a vertical direction, that is, the up-and-down direction in FIG. 1 is explained as the "up-and-down direction". Further, a direction in which a medium P is fed by the medium feeding apparatus 1 is explained as a "feeding direction", a direction orthogonal to the feeding direction and a thickness direction of a medium P is explained as a "width direction", and the thickness direction of a medium P orthogonal to the feeding direction and the width direction is explained as a "height direction". In an example of FIG. 1, the front side of the medium feeding apparatus corresponds to the upstream side in the feeding direction and the back side of the medium feeding apparatus corresponds to the downstream side in the feeding direction.

The medium feeding apparatus 1 includes a rotating unit 3 and a fixed unit 4. The medium feeding apparatus 1 is placed so that the rotating unit 3 is positioned on the upper side in the up-and-down direction and the fixed unit 4 is positioned on the lower side in the up-and-down direction. The rotating unit 3 is rotatably supported by the fixed unit 4 on the back side in the front-and-rear direction. The rotating unit 3 can rotate relative to the fixed unit 4 about a rotating shaft 5, which is along the width direction, as the center of rotation in a predetermined rotation range.

Further, the medium feeding apparatus 1 includes a hopper 2, a feeder 6, a separator 7, a conveyor 8, and a controller 20.

Stacked media P are loaded on the hopper 2, and the hopper 2 can be moved up and down in the up-and-down direction (the thickness direction of the medium P) and includes a loading surface 2*a* that is formed in a substantially rectangular shape. A plurality of media P are stacked and loaded on the loading surface 2*a* of the hopper 2. Further, the hopper 2 is connected to a hopper driving motor 17 through a power transmission mechanism (not shown). When the hopper driving motor 17 is driven, the hopper 2 is moved up and down in the up-and-down direction according to the quantity of media P loaded on the loading surface 2*a*.

The feeder 6, the separator 7, and the conveyor 8 are provided at a predetermined interval on a conveying path along which a medium P1 is conveyed in the feeding direction. The feeder 6, the separator 7, and the conveyor 8 are positioned in this order from the upstream side toward the downstream side in the feeding direction.

The feeder 6 is a so-called upper picking type sheet feeding mechanism, feeds the media P loaded on the hopper 2, and includes a pick roller 61. The pick roller 61 feeds the uppermost medium P1 among the media P loaded on the hopper 2 and is made of, for example, a material having a large friction force such as foamed rubber so as to have a columnar shape. The pick roller 61 is installed so that the central axis of the pick roller 61 is substantially parallel to the width direction of the loading surface 2*a*, that is, is orthogonal to the feeding direction of the medium P while being along the loading surface 2*a*. Further, the central axis of the pick roller 61 is set on the upper surface of the hopper 2 (on the loading surface 2*a*), and the outer peripheral surface of the pick roller 61 is set at a position that has a predetermined interval interposed between the loading surface 2*a* of the hopper 2 and the outer peripheral surface of the pick roller in the height direction. The media P are loaded on the loading surface 2*a* so that the rear ends of the media P (upstream ends of the media in the feeding direction) are positioned on the upstream side of the pick roller 61 in the feeding direction. The hopper 2 approaches the pick roller 61 by being moved upward in the height direction, and is separated from the pick roller 61 by being moved downward.

Further, the pick roller 61 is connected to a roller driving motor 16 as a driving unit through a transmission gear or a belt (not shown), and is driven by a rotational driving force of the roller driving motor 16 so as to rotate about the central axis thereof as the center of rotation. The pick roller 61 is rotationally driven in a pick direction, that is, in a direction in which the outer peripheral surface of the pick roller 61 faces the separator 7 and the conveyor 8 on the loading surface 2*a* (a clockwise direction shown in FIG. 1 by an arrow).

The separator 7 separates the media P, which are fed from the hopper 2 by the feeder 6, one by one and includes a separating roller 71 and a braking roller 72. The separating roller 71 is made of, for example, a material having a large friction force such as foamed rubber so as to have a columnar shape. The separating roller 71 is provided on the downstream side of the pick roller 61 in the feeding direction so as to be substantially parallel to the pick roller 61. That is, the separating roller 71 is installed so that the central axis of the separating roller 71 is orthogonal to the feeding direction of the medium P while being along the loading surface 2*a*. Further, the central axis of the separating roller 71 is set on the upper surface of the hopper 2, and the outer peripheral surface of the separating roller 71 is set at a position that has a predetermined interval interposed between the loading surface 2*a* of the hopper 2 and the outer peripheral surface of the separating roller 71 in the height direction. The separating roller 71 is connected to the roller driving motor 16 through a transmission gear or a belt (not shown) for the purpose of making the apparatus compact, and is driven by a rotational driving force of the roller driving motor 16 so as to rotate about the central axis thereof as the center of rotation. That is, the pick roller 61 and the separating roller 71 use the roller driving motor 16 as a driving unit in common. However, the invention is not limited thereto and a driving motor may be separately provided as a driving unit that rotationally drives the separating roller 71. Just like the pick roller 61, the separating roller 71 is rotationally driven in a direction in which the outer peripheral surface of the separating roller 71 faces the conveyor 8 on the loading surface 2*a* (a clockwise direction shown in FIG. 1 by an arrow).

The braking roller 72 restricts the feeding of other media P except for a medium P1 that comes into direct contact with the pick roller 61. The braking roller 72 has substantially the same length as the length of the separating roller 71, and is formed in a columnar shape. Just like the separating roller 71, the braking roller 72 is provided so that the central axis of the braking roller 72 horizontally crosses the feeding direction of the medium P, that is, is along the width direction of the medium P. Further, the braking roller 72 is provided so as to be rotatable about the central axis thereof as a rotation axis. The braking roller 72 is provided so as to face the separating roller 71 and come into contact with the separating roller 71 in the height direction on the side of the loading surface 2*a*, and is pressed against (biased to) the separating roller 71 by a biasing unit (not shown). In this embodiment, a state in which the braking roller 72 comes into contact with the separating roller 71 is also expressed as "press contact" meaning a state in which the braking roller 72 is pressed against separating roller 71 at an arbitrary contact pressure. Since the braking roller 72 comes into press contact with the separating roller 71, the braking roller 72 is rotated following the rotation of the separating roller 71 in a direction in which the outer peripheral surface of the braking roller 72 faces the conveyor 8 on the contact surface between the separating roller 71 and the braking roller 72.

Meanwhile, a structure that stops and separates media P fed together with the uppermost medium P1 fed by the feeder 6 by rotationally driving the braking roller 72 in a direction opposite to the rotational driving direction of the separating roller 71 may be used instead of a structure that presses the braking roller 72 against the separating roller 71 by the biasing unit (not shown). Further, the braking roller 72 only has to be capable of functioning to apply a predetermined conveying load to a medium P entering a gap between the separating roller 71 and the braking roller 72 by coming into press contact with the separating roller 71. For example, the braking roller 72 may be substituted with a structure (braking unit), such as a separating pad or a separating belt, other than a roller.

The conveyor 8 conveys the medium P1, which is fed by the feeder 6 and has passed through the separator 7, to each unit, which is provided on the further downstream side in the feeding direction, of an apparatus on which the medium feeding apparatus 1 is mounted. For example, when the medium feeding apparatus 1 is mounted on an image reader, an optical unit or the like as an image reading unit that reads images recorded on the medium P1 is provided on the downstream side of the conveyor 8 in the feeding direction. Accordingly, the images of the medium P1, which is conveyed in the image reader by the conveyor 8, are read by the optical unit.

Specifically, the conveyor 8 includes a conveying roller 81 that can be rotationally driven and a driven roller 82 that can be rotated following the conveying roller 81. The conveying roller 81 and the driven roller 82 have substantially the same length and are formed in a columnar shape. The conveying roller 81 and the driven roller 82 are provided so that the central axis of the conveying roller 81 and the driven roller 82 horizontally cross the feeding direction of the medium P1, that is, are along the width direction of the medium P1. Further, each of the conveying roller 81 and the driven roller 82 is provided so as to be rotatable about the central axis thereof as a rotation axis. The driven roller 82 is provided so as to face the conveying roller 81 and come into contact with the conveying roller 81, and is pressed against (biased to) the conveying roller 81 by a biasing unit (not shown). In this embodiment, a state in which the driven roller 82 comes into contact with the conveying roller 81 is also expressed as "press contact" meaning a state in which the driven roller 82 is pressed against the conveying roller 81 at an arbitrary contact pressure.

When the conveying roller 81 conveys the medium P1, the conveying roller 81 is rotationally driven in a direction in which the outer peripheral surface of the conveying roller 81 faces the inside of the apparatus, to which the medium feeding apparatus 1 is applied, from the separator 7 on the contact surface between the driven roller 82 and the conveying roller 81 (a clockwise direction shown in FIG. 1 by an arrow). Since the driven roller 82 comes into press contact with the conveying roller 81, the driven roller 82 is rotated following the rotation of the conveying roller 81 in a direction in which the outer peripheral surface of the driven roller 82 faces the inside of the apparatus from the separator 7 on the contact surface between the conveying roller 81 and the driven roller 82. Further, the conveyor 8 holds the medium P1 between the outer peripheral surface of the conveying roller 81 and the outer peripheral surface of the driven roller 82 by the pressing of the driven roller 82, and conveys the medium P1 by the rotational driving of the conveying roller 81 as explained above. Furthermore, the medium P1 is conveyed to each unit, which is provided in the apparatus to which the medium feeding apparatus 1 is applied, for example, the optical unit by being sequentially delivered between pairs of rollers that are formed of a plurality of conveying rollers (not shown) and a plurality of driven rollers (not shown) provided along the conveying path.

Meanwhile, the conveying roller 81 is also connected to the roller driving motor 16 through a transmission gear or a belt (not shown) for the purpose of making the apparatus compact. That is, the pick roller 61, the separating roller 71, and the conveying roller 81 use the roller driving motor 16 as a driving unit in common. However, the invention is not limited thereto and a driving motor may be separately provided as a driving unit that rotationally drives the conveying roller 81. Here, the rotational speed of the conveying roller 81 is adjusted by the transmission gear or the like, so that the conveying roller 81 is rotationally driven at a rotational speed relatively higher than the rotational speeds of the pick roller 61 and the separating roller 71. That is, the conveyor 8 can convey the medium P1, which is separated by the separator 7, at a speed higher than the speed of the medium P1 that is fed by the feeder 6. However, the conveyor 8 is not limited thereto, and may convey the medium P1 at the same speed as the speed of the medium P1 that is fed by the feeder 6.

As shown in FIG. 2, medium detecting sensors 14*a*, 14*b*, and 14*c* (a first medium detecting unit, a second medium detecting unit, and a third medium detecting unit) that detect the presence or absence of a medium are installed on a conveying path of a medium P1. The medium detecting sensor 14*a* (also referred to as a "sensor A") is installed on the downstream side of a conveyor 8, the medium detecting sensor 14*b* (also referred to as a "sensor B") is installed between a separator 7 and the conveyor 8, and the medium detecting sensor 14*c* (also referred to as a "sensor C") is installed between a feeder 6 and the separator 7.

For example, when the medium P1 is present in a detection range, the detection signals of the medium detecting sensors 14*a*, 14*b*, and 14*c* are in an ON state. Meanwhile, when the medium P1 is not present in the detection range, the detection signals of the medium detecting sensors 14*a*, 14*b*, and 14*c* are in an OFF state. Since the medium P1 is present between the feeder 6 and the separator 7 in an example of FIG. 2, the medium detecting sensor 14*c* is in an ON state and the medium detecting sensors 14*a* and 14*b* are in an OFF state.

The controller 20 controls the respective units of the medium feeding apparatus 1. Various sensors, such as medium detecting sensors 14*a*, 14*b* and 14*c* that detect the presence or absence of the medium P1 on the conveying path and a double-feed detecting sensor 15 that detects the double-feed of the medium P1, the roller driving motor 16, and the hopper driving motor 17 are electrically connected to the controller 20. The controller 20 receives information from various sensors, such as a medium detecting sensor 14 and the double-feed detecting sensor 15. The controller 20 feeds the medium P1 in the feeding direction by controlling the roller driving motor 16 or the hopper driving motor 17 to drive each of the rollers of the feeder 6, the separator 7, and the conveyor 8 or the hopper 2.

As shown in FIG. 1, the controller 20 is physically a microcomputer including hardware, such as a central processing unit (CPU) 20*a*, a random access memory (RAM) 20*b*, a read only memory (ROM) 20*c*, a memory unit 20*d*, such as an electrically erasable and programmable read only memory (EEPROM) or a hard disk drive (HDD), an interface 20*e* that communicates with the respective units provided inside and outside the apparatus, an input device 20*f*, such as a switch, a keyboard, and a mouse, and a display device 20*g* such as a display. All or a part of the respective functions of the controller 20 to be explained below are realized by operating the interface 20*e*, the input device 20*f*, the display device 20*g*, and the like under the control of the CPU 20*a* and reading and writing data on the RAM 20*b*, the ROM 20*c*, and the memory unit 20*d* through the reading of a predetermined application program on the hardware, such as the CPU 20*a*, the RAM 20*b*, and the ROM 20*c*.

Meanwhile, the controller 20 may be built in the medium feeding apparatus 1 so as to be integrated with the medium feeding apparatus 1, or may be provided separately from the medium feeding apparatus 1 like, for example, a personal computer (PC) so as to be connected to the medium feeding apparatus 1 from the outside.

As shown in FIG. 1, the pick roller 61 of the feeder 6, the separating roller 71 of the separator 7, and the conveying roller 81 of the conveyor 8 are installed at the lower end of the rotating unit 3. The braking roller 72 of the separator 7 and the driven roller 82 of the conveyor 8 are installed at the upper end of the fixed unit 4. The hopper 2 is installed on the front side of the fixed unit 4. The rotating shaft 5 of the rotating unit 3 is disposed on the back side of the conveyor 8. The rotating unit 3 is rotated about the rotating shaft 5 as the center of rotation toward the fixed unit 4, and is fixed into the fixed unit 4 so that the braking roller 72 of the separator 7 comes into press contact with the separating roller 71 and the driven roller 82 of the conveyor 8 comes into press contact with the conveying roller 81, that is, the conveying path of the medium P1 is formed between the separating roller 71 and the braking roller 72 of the separator 7 and between the conveying roller 81 and the driven roller 82 of the conveyor 8.

The rotating unit 3 is provided with a lock arm 9. The lock arm 9 is supported by a rotating shaft 10 so as to be rotatable relative to the rotating unit 3. The lock arm 9 uses the rotating shaft 10 as the center of rotation, and includes an arm portion 9*a* that extends in a radial direction and a locking claw 9*b* that is bent at the tip of the arm portion 9*a* in a circumferential direction. Meanwhile, a fixed unit 4 is provided with a lock shaft 11. The lock shaft 11 is disposed substantially parallel to the rotating shaft 10 of the lock arm 9. The locking claw 9*b* of the lock arm 9 is adapted to be in a locking state in which the locking claw 9*b* comes into contact with the lock shaft 11 from below by being inserted below the lock shaft 11 by the rotation of the lock arm 9 about the rotating shaft 10.

As shown in FIG. 1, a force Fopen is biased to the rotating unit 3 in a direction in which the rotating unit 3 is rotated upward about a rotating shaft 5. Since the locking claw 9*b* of the lock arm 9 is locked to the lock shaft 11, the upward rotation of the rotating unit 3 caused by the force Fopen is restricted. Accordingly, the conveying path is maintained in the separator 7 and the conveyor 8.

When a conveying path needs to be opened such as when a conveyance error, such as a jam or double-feed, occurs on the conveying path in the related art, an operator needs to manually rotate a lock arm 9 to release the locking between a locking claw 9*b* and a lock shaft 11 and separate a rotating unit 3 from a fixed unit 4 to the upper side. Further, after recovery work is completed, the operator needs to manually fit the rotating unit 3 to the fixed unit 4 again and rotate the lock arm 9 to lock the locking claw 9*b* to the lock shaft 11. This work causes total time, which is taken for the recovery work, or the workload of an operator to increase.

In contrast, in this embodiment, the lock shaft 11 is automatically moved in the up-and-down direction while the lock arm 9 is locked to the lock shaft 11. Accordingly, the position of the rotating unit 3 relative to the fixed unit 4 is changed, so that the conveying path is opened and closed.

As shown in FIG. 1, a link member 12 is a member that linearly extends in the up-and-down direction, an upper end of the link member 12 is connected to the lock shaft 11, and a lower end of the link member 12 is connected to a rotating member 13. The rotating member 13 is supported so as to be rotatable about a rotation fulcrum that is substantially parallel to the axial direction of the lock shaft 11. The rotating member 13 linearly extends in a direction orthogonal to the axial direction of the rotation fulcrum, and one end (or end portion) 13*a* of the rotating member 13 is connected to the link member 12. Further, the other end (or end portion) 13*b* of the rotating member 13 is exposed to the front side of the fixed unit 4, and is disposed so as to be capable of coming into contact with the lower surface of the hopper 2. Furthermore, the rotating member 13 is disposed so that the end 13*b* is positioned above the end 13*a* while the rotating unit 3 is fitted to the fixed unit 4. That is, an angle that is formed between the link member 12 and the rotating member 13 at this time is an acute angle.

In this embodiment, the hopper 2 is adapted to be movable from a "normal position" at which the medium P1 is fed to the conveying path to a "release position" (see FIG. 5), which is present below the normal position, in the up-and-down direction. When the hopper 2 is moved to the release position, the end 13*b* of the rotating member 13 is pressed downward by the lower surface of the hopper 2. Accordingly, the rotating member 13 is rotated in a direction in which the end 13*a* is pushed upward (the clockwise direction in FIG. 1).

FIG. 3 is a functional block diagram of the medium feeding apparatus shown in FIG. 1. The controller 20 of this embodiment can perform an operation for automatically opening the conveying path by moving the lock shaft 11 upward as explained above and can perform an operation for automatically closing the conveying path by moving the lock shaft 11 downward after the completion of the recovery work, according to the detection of a conveyance error. In regard to the functions, the controller 20 is adapted to achieve the respective functions of a conveyance control unit 21, an error detecting unit 22, and an error release operation control unit 23 as shown in FIG. 3.

The conveyance control unit 21 controls the conveyance of the medium P1 on the conveying path by controlling the rotation of each of the rollers of the feeder 6, the separator 7, and the conveyor 8 through the adjustment of the controlled variable of the roller driving motor 16. Further, when a conveyance error is detected by the error detecting unit 22, the conveyance control unit 21 stops an operation for conveying the medium P1 by stopping the drive of the roller driving motor 16.

The error detecting unit 22 detects the occurrence of a conveyance error on the conveying path. The error detecting unit 22 can detect a jam (paper jam) on the basis of the delay of the arrival time of the medium P1 or the deflection amount of the medium P1 that is detected by, for example, the medium detecting sensors 14*a*, 14*b*, and 14*c*. In addition, the error detecting unit 22 is adapted to be capable of specifying a portion where a conveyance error occurs on the conveying path on the basis of the detection signals of the medium detecting sensors 14*a*, 14*b*, and 14*c*.

Further, the error detecting unit 22 can detect double-feed according to a measurement signal of the double-feed detecting sensor 15. When detecting a conveyance error, the error detecting unit 22 outputs an effect that a conveyance error is detected to the conveyance control unit 21 and an error release operation control unit 23.

The error release operation control unit 23 controls an operation for automatically opening/closing the rotating unit 3 according to the occurrence of a conveyance error. When a conveyance error occurs, recovery work for removing a medium P causing the conveyance error from the conveying path needs to be performed by an operator as explained above. The error release operation control unit 23 automatically performs an operation for opening/closing the rotating unit 3 that is performed before and after the recovery work. When a conveyance error is detected by the error detecting unit 22, the error release operation control unit 23 moves the hopper 2 downward by controlling the hopper driving motor 17 and moves the lock shaft 11 upward by applying an upward thrust to the lock shaft 11 through the rotating member 13 and the link member 12. Further, when the recovery work performed by the operator is completed and the removal of the medium P causing the conveyance error from the conveying path is detected, the error release operation control unit 23 moves the hopper 2 upward by controlling the hopper driving motor 17 again and allows the lock shaft 11 to move to the original lower position. In this embodiment, both the recovery work that is associated with the occurrence of a conveyance error and an operation for automatically opening/closing the rotating unit 3 that is performed before and after the recovery work are expressed as an "error release operation".

The medium feeding apparatus is adapted to be quickly recovered from an error state by switching the degree of opening of an operation for automatically opening/closing the rotating unit 3 for the recovery work according to a portion where a conveyance error occurs specified by the error detecting unit 22. Accordingly, the medium feeding apparatus can improve productivity.

Figure 4:
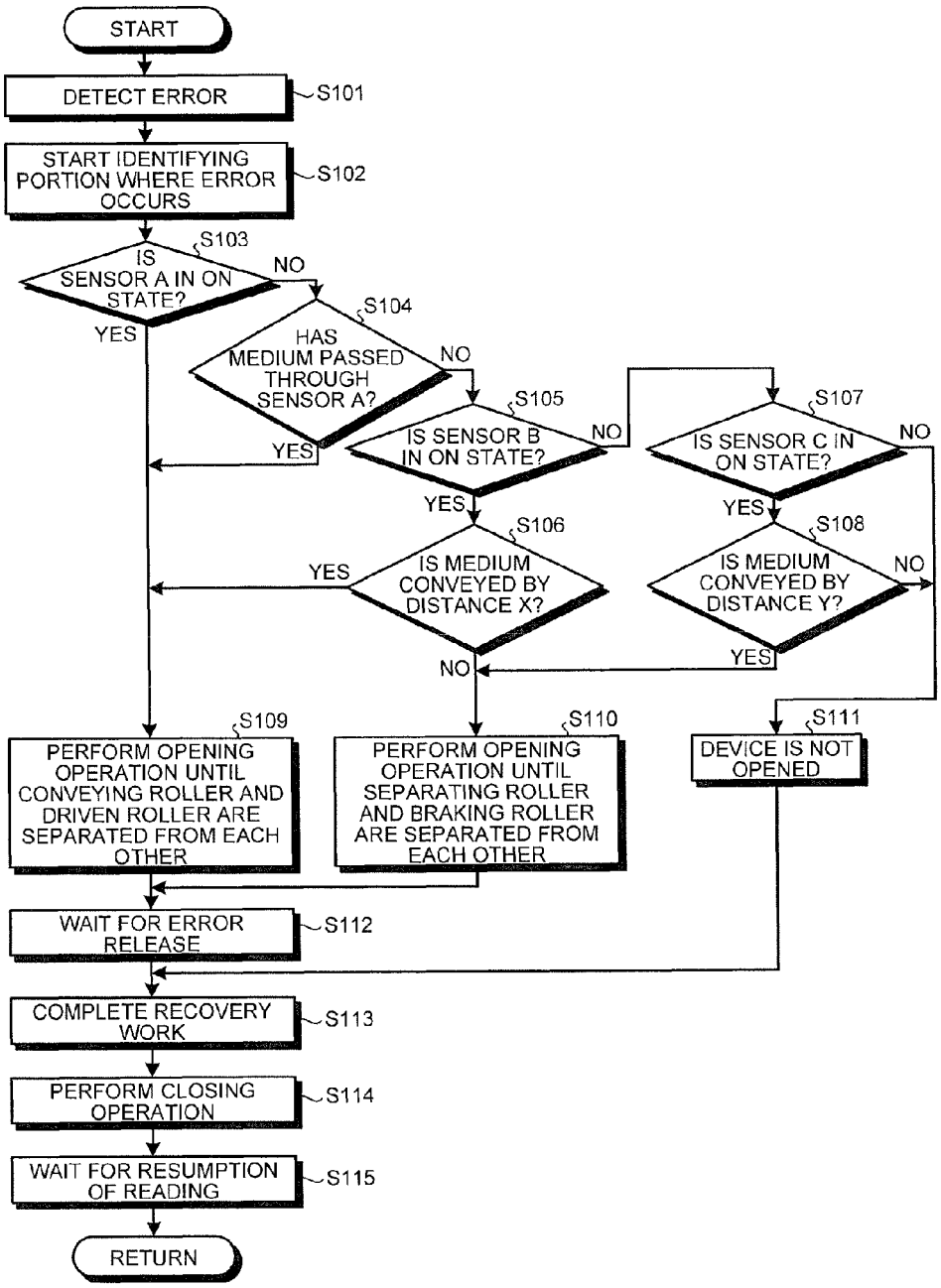
FIG. 4 is a flowchart for explaining error release processing when a conveyance error occurs in the medium feeding apparatus according to the first embodiment.
Figure 5:
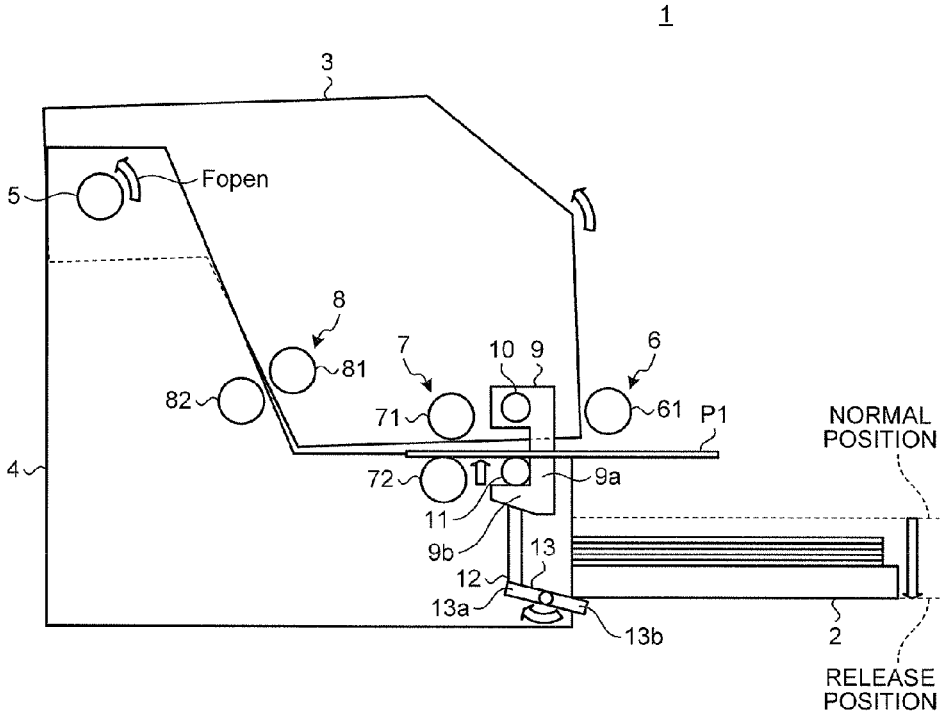
FIG. 5 is a schematic diagram for explaining a state in which a conveying path is opened by an error release operation.

Next, the operation of the medium feeding apparatus 1 according to the first embodiment will be explained with reference to FIGS. 4 and 5. FIG. 4 is a flowchart for explaining error release processing when a conveyance error occurs in the medium feeding apparatus 1 according to the first embodiment. FIG. 5 is a schematic diagram for explaining a state in which the conveying path is opened by the error release operation.

In the flowchart of FIG. 4, a structure in which the medium feeding apparatus 1 is applied to an image reader such as a scanner, that is, a situation in which a medium P is conveyed by the medium feeding apparatus 1 when an image reading operation for the medium P is performed by an image reader is exemplified and error release processing will be explained. The processing of the flowchart shown in FIG. 4 is performed by the controller 20 of the medium feeding apparatus 1 whenever an image reading operation for a medium performed by the image reader is performed.

On the premise of a flowchart of FIG. 4, the roller driving motor 16 is driven by the conveyance control unit 21 and each of the rollers of the feeder 6, the separator 7, and the conveyor 8 is rotated, so that an operation for conveying the medium P present on the hopper 2 to the image reader provided on the downstream side in the conveying direction is performed. During the operation for conveying the medium performed by the conveyance control unit 21, the error detecting unit 22 sequentially checks whether a conveyance error, such as double-feed or a jam, occurs on the conveying path.

When a conveyance error is detected by the error detecting unit 22 (Step S101), processing for identifying a portion where the conveyance error occurs is started (Step S102). The error detecting unit 22 specifies the portion where the conveyance error occurs on the conveying path on the basis of the detection signals of the medium detecting sensors 14*a*, 14*b*, and 14*c*. A process subsequently proceeds to Step S103.

It is determined in Step S103 whether the medium detecting sensor 14*a* (sensor A) installed on the downstream side of the conveyor 8 is in an ON state. If the sensor A is in an ON state as a result of the determination of Step S103 (Yes in Step S103), the process proceeds to Step S109. If the sensor A is in an OFF state (No in Step S103), the process proceeds to Step S104.

If it is determined in Step S103 that the sensor A is in an OFF state, it is subsequently determined in Step S104 whether the medium P has passed through the sensor A. The error detecting unit 22 can determine that the medium P has passed through the sensor A, for example, when the temporal change of the detection signal of the sensor A is switched into an OFF state from an ON state. If the medium P has passed through the sensor A as a result of the determination of Step S104 (Yes in Step S104), the process proceeds to Step S109. If the medium P does not have passed through the sensor A (No in Step S104), the process proceeds to Step S105.

If it is determined in Steps S103 and S104 that the medium P is not present on the sensor A and does not have passed through the sensor A, it is determined in Step S105 whether the medium detecting sensor 14*b* (sensor B) installed on the downstream side of the separator 7 is in an ON state. If the sensor B is in an ON state as a result of the determination of Step S105 (Yes in Step S105), the process proceeds to Step S106. If the sensor B is in an OFF state (No in Step S105), the process proceeds to Step S107.

If it is determined in Step S105 that the medium is present on the sensor B, it is determined in Step S106 whether the medium P is conveyed by a distance equal to or longer than a distance X after reaching the sensor B. As shown in FIG. 2, the distance X is a distance between the sensor B and the conveyor 8. That is, if the medium P is sent by the distance X, the medium P reaches the conveyor 8. The error detecting unit 22 can calculate a conveying distance in consideration of, for example, the counted number of pulses of the roller driving motor 16 that drives a separating roller 71 of the separator 7, the gear ratio of a power transmission system between the roller driving motor 16 and the separating roller 71, or the like. If the medium is conveyed by a distance equal to or longer than the distance X after reaching the sensor B as a result of the determination of Step S106 (Yes in Step S106), the process proceeds to Step S109. If the conveying distance of the medium P is shorter than the distance X (No in Step S106), the process proceeds to Step S110.

If it is determined in Steps S103 to S105 that the medium P is not present on the sensors A and B, it is determined in Step S107 whether the medium detecting sensor 14*c* (sensor C) installed on the downstream side of the feeder 6 is in an ON state. If the sensor C is in an ON state as a result of the determination of Step S107 (Yes in Step S107), the process proceeds to Step S108. If the sensor C is in an OFF state (No in Step S107), the process proceeds to Step S111.

If it is determined in Step S107 that the medium P is present on the sensor C, it is determined in Step S108 whether the medium P is conveyed by a distance equal to or longer than a distance Y after reaching the sensor C. As shown in FIG. 2, the distance Y is a distance between the sensor C and the separator 7. That is, if the medium P is sent by the distance Y, the medium P reaches the separator 7. The error detecting unit 22 can calculate a conveying distance in consideration of, for example, the counted number of pulses of the roller driving motor 16 that drives a pick roller 61 of the feeder 6, the gear ratio of a power transmission system between the roller driving motor 16 and the pick roller 61, or the like. If the medium P is conveyed by a distance equal to or longer than the distance Y after reaching the sensor C as a result of the determination of Step S108 (Yes in Step S108), the process proceeds to Step S110. If the conveying distance of the medium P is shorter than the distance Y (No in Step S108), the process proceeds to Step S111.

Since it can be determined in Step S109 that the medium P is present on the conveyor 8 or the downstream side of the conveyor 8 as a result of the processing for identifying a portion where an error occurs performed by the error detecting unit 22, an opening operation is performed by the error release operation control unit 23 so that the degree of opening becomes the degree of opening in which a conveying roller 81 and a driven roller 82 of the conveyor 8 are separated from each other. When the processing of Step S109 is completed, the process proceeds to Step S112.

Since it can be determined in Step S110 that the medium is present on the separator 7 or the downstream side of the separator 7 as a result of the processing for identifying a portion where an error occurs performed by the error detecting unit 22, an opening operation is performed by the error release operation control unit 23 so that the degree of opening becomes the degree of opening in which the separating roller 71 and a braking roller 72 of the separator 7 are separated from each other. When the processing of Step S110 is completed, the process proceeds to Step S112.

Here, the "opening operation" performed in Steps S109 and S110 is an operation for moving downward the position of the hopper 2 in the up-and-down direction from the "normal position" at which a conveying operation for feeding the medium P to the conveying path is performed to the "release position", which is present below the normal position, as shown in FIG. 5. The error release operation control unit 23 moves the hopper 2 downward by driving a hopper driving motor 17. When the hopper 2 is moved downward to the release position by the opening operation, the end portion 13*b* of the rotating member 13 comes into contact with the lower surface of the hopper 2 and is pressed downward. Accordingly, the rotating member 13 is rotated about the rotation fulcrum as the center of rotation in the direction in which the end portion 13*b* is moved downward (the clockwise direction shown in FIG. 5 by an arrow). Since the end portion 13*a* of the rotating member 13 is moved upward by the rotation of the rotating member 13, the link member 12 connected to the end portion 13*a* is moved upward and the position of the lock shaft 11 connected to the link member 12 in the up-and-down direction is also moved upward.

At this time, the locking claw 9*b* of the lock arm 9 comes into contact with the lock shaft 11 from below and receives the force Fopen in the direction in which the rotating unit 3 is rotated upward about the rotating shaft 5 through the rotating shaft 10 and the arm portion 9*a*. For this reason, the lock arm 9 is moved upward with the upward movement of the lock shaft 11 in the up-and-down direction while following the lock shaft 11. Accordingly, the rotating unit 3 is rotated upward by a distance at which the lock shaft 11 and the lock arm 9 are moved upward. As a result, a gap is formed between the rollers of each of the separator 7 and the conveyor 8 and the conveying path is opened.

The error release operation control unit 23 can control the degree of opening of the opening operation by appropriately adjusting the upward moving distance of the lock shaft 11 through the appropriate adjustment of, for example, the downward moving distance of the hopper 2.

Returning to FIG. 4, since it can be determined in Step S111 that the medium is present on the feeder 6 or the downstream side of the feeder 6 as a result of the processing for identifying a portion where an error occurs performed by the error detecting unit 22, an opening operation is not performed by the error release operation control unit 23. The error release operation control unit 23 may inform an operator of a conveyance error, which occurs near the pick roller 61, through, for example, a display device 20*g* or the like. When the processing of Step S111 is completed, the process proceeds to Step S113.

When an opening operation is performed in Steps S109 and S110, the operator of the image reader performs recovery work for removing a medium, which corresponds to a conveyance error, from the conveying path while the conveying path is opened by the opening operation. During the recovery work, the error release operation control unit 23 makes a waiting state for an error release operation (Step S112) and sequentially checks whether the recovery work of the operator has been completed. The completion of the recovery work can be determined on the basis of, for example, the detection signals of the medium detecting sensors 14*a*, 14*b*, and 14*c* provided on the conveying path.

For example, since the medium stays on the conveying path when a conveyance error occurs, at least one of the medium detecting sensors 14*a*, 14*b*, and 14*c* is in an ON state. Meanwhile, when the recovery work has been completed and the medium has been removed from the conveying path, all of the detection signals of the medium detecting sensors 14*a*, 14*b*, and 14*c* are in an OFF state. That is, it can be determined that the recovery work has been completed when the detection signals of the medium detecting sensors 14*a*, 14*b*, and 14*c* are in an OFF state. Meanwhile, a method other than a method using the medium detecting sensors 14*a*, 14*b*, and 14*c* may be used as a method of determining the completion of the recovery work. For example, a method of determining the completion of the recovery work using the information of various sensors other than the medium detecting sensors 14*a*, 14*b*, and 14*c* installed in the medium feeding apparatus 1 may be used, and a method of detecting the completion of the recovery work by the input of an instruction of an operator may be used.

If the completion of the recovery work is detected by the error release operation control unit 23 (Step S113), a closing operation is performed (Step S114).

The "closing operation" started in Step S114 is an operation reverse to the opening operation of Steps S109 and S110. That is, the closing operation is an operation for returning the position of the hopper 2 in the up-and-down direction to the "normal position" by moving the position of the hopper 2 upward from the "release position" to which the hopper has been moved by the opening operation. The error release operation control unit 23 moves the hopper 2 upward by driving the hopper driving motor 17. When the hopper 2 is moved upward from the release position by the closing operation, a downward pressing force applied to the end portion 13*b* of the rotating member 13 from the lower surface of the hopper 2 is removed. For this reason, the rotating member 13 is rotated in the direction in which the end portion 13*a* is moved downward (the counterclockwise direction in FIG. 5). The link member 12 connected to the end portion 13*a* of the rotating member 13 is moved downward by the rotation of the rotating member 13, and the position of the lock shaft 11, which is connected to the link member 12, in the up-and-down direction is also moved downward.

At this time, the positions of the lock arm 9 and the lock shaft 11 in the up-and-down direction are moved downward against the force Fopen. Accordingly, the rotating unit 3 is rotated downward by a downward moving distance of the lock shaft 11 and the lock arm 9. As a result, the rollers of each of the separator 7 and the conveyor 8 come into press contact with each other and the conveying path is closed, so that a state returns to a state in which a medium can be conveyed to the conveying path. That is, a state can be changed into the state shown in FIG. 1 from the state shown in FIG. 5 by the closing operation.

Returning to FIG. 4, when the closing operation is completed, a waiting state for a reading resuming instruction input by an operator is made (Step S115) and this control flow is completed.

Next, the effects of the medium feeding apparatus 1 according to the first embodiment will be explained.

The medium feeding apparatus 1 according to the first embodiment includes the separating roller 71 that feeds a medium in a conveying direction, the braking roller 72 that is disposed so as to come into press contact with the separating roller 71 and applies a predetermined conveying load to the medium entering a gap between the separating roller 71 and the braking roller 72, the conveying roller 81 that is disposed on the downstream side of the separating roller 71 in the conveying direction, and the driven roller 82 that is disposed so as to come into press contact with the conveying roller 81. The medium feeding apparatus 1 includes an opening unit that performs an opening operation in a direction in which the rollers coming into press contact with each other on the conveying path for the medium are separated from each other when a conveyance error of the medium occurs. In this embodiment, a component that includes the lock shaft 11 moving in the up-and-down direction, the lock arm 9 opening/closing the rotating unit 3 while interlocking with the operation of the lock shaft 11, the hopper 2, and the link member 12 and the rotating member 13 transmitting a thrust from the hopper 2 to the lock shaft 11 functions as the opening unit. The operation of the opening unit is controlled by the error release operation control unit 23 of a controller 20. The error release operation control unit 23 controls the opening unit by switching whether an opening operation is performed to the degree of opening in which the conveying roller 81 and the driven roller 82 are separated from each other or an opening operation is performed to the degree of opening in which the separating roller 71 and the braking roller 72 are separated from each other, according to the entering distance of the medium on the conveying path.

According to this configuration, the degree of opening of the opening operation can be suppressed to the minimum degree required for the removal of a medium by the switching of the degree of opening of the opening operation for the recovery work for removing a medium according to the position that a conveyance error occurs. Accordingly, time, which is taken for the opening operation and the recovery work, can be reduced, so that the efficiency of the recovery work at the time of the occurrence of a conveyance error can be improved.

Further, the medium feeding apparatus 1 according to the first embodiment includes the medium detecting sensor 14*a* that is disposed on the downstream side of the conveying roller 81 provided on the conveying path in the conveying direction and detects the medium, and the medium detecting sensor 14*b* that is disposed between the separating roller 71 and the conveying roller 81 provided on the conveying path and detects the medium. The error release operation control unit 23 controls the opening unit so that the opening unit performs an opening operation to the degree of opening in which the conveying roller 81 and the driven roller 82 are separated from each other when the medium detecting sensor 14*a* detects that the medium enters the gap between the conveying roller 81 and the driven roller 82 and the opening unit performs an opening operation to the degree of opening in which the separating roller 71 and the braking roller 72 are separated from each other when the medium detecting sensor 14*b* detects that the medium enters the gap between the separating roller 71 and the braking roller 72.

According to this configuration, whether a medium causing a conveyance error reaches the conveyor 8 or reaches the separator 7 can be accurately identified, so that the degree of opening of an opening operation can be set appropriately. Accordingly, the efficiency of the recovery work at the time of the occurrence of a conveyance error can be further improved.

Further, the medium feeding apparatus 1 according to the first embodiment includes the pick roller 61 that is disposed on the upstream side of the separating roller 71 in the conveying direction and sends the medium loaded on the hopper 2 to the downstream side, and the medium detecting sensor 14*c* that is disposed between the pick roller 61 and the separating roller 71 provided on the conveying path and detects the medium. The error release operation control unit 23 controls the opening unit so that the opening unit performs an opening operation to the degree of opening in which the separating roller 71 and the braking roller 72 are separated from each other when the medium detecting sensor 14*c* detects that the medium enters the gap between the separating roller 71 and the braking roller 72 and the opening unit does not perform an opening operation when the medium detecting sensor 14*c* detects that the medium does not enter the gap between the separating roller 71 and the braking roller 72.

According to this configuration, whether a medium causing a conveyance error reaches the conveyor 8 or reaches the separator 7 or whether the medium is present on the upstream side of the separator 7 can be accurately identified, so that the degree of opening of an opening operation can be set appropriately. Accordingly, the efficiency of the recovery work at the time of the occurrence of a conveyance error can be further improved.

The configuration in which the medium feeding apparatus 1 according to the first embodiment includes three medium detecting sensors 14*a*, 14*b*, and 14*c* on the conveying path has been exemplified, but one of the medium detecting sensors 14*a* and 14*b* may not be provided. If the medium detecting sensor 14*a* is not provided, for example, the medium detecting sensor 14*b* can determine whether a medium enters a gap between the conveying roller 81 and the driven roller 82 of the conveyor 8 on the basis of a conveying distance of the medium after detecting the medium. Further, if the medium detecting sensor 14*b* is not provided, for example, the medium detecting sensor 14*c* can determine whether a medium enters a gap between the separating roller 71 and the braking roller 72 of the separator 7 on the basis of a conveying distance of the medium after detecting the medium.

Modification of First Embodiment

Figure 6:
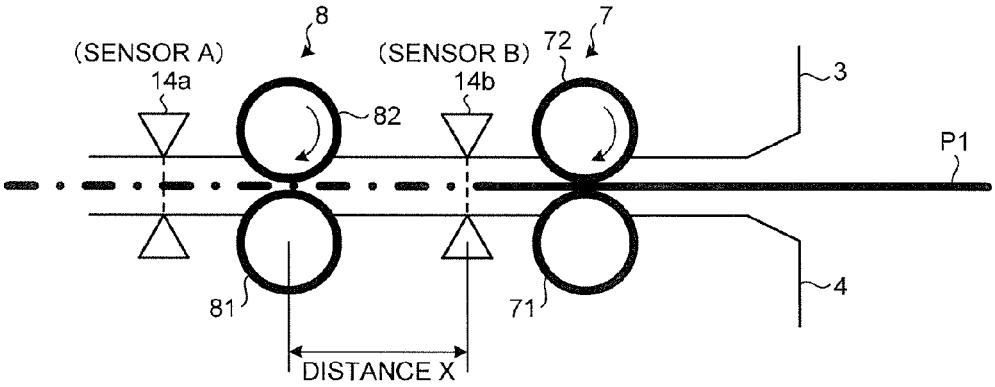
FIG. 6 is an enlarged schematic diagram of components provided near a conveying path of a medium feeding apparatus according to a modification of the first embodiment.

Next, a modification of the first embodiment will be explained with reference to FIGS. 6 and 7. FIG. 6 is an enlarged schematic diagram of components provided near a conveying path of a medium feeding apparatus according to a modification of the first embodiment, and FIG. 7 is a flowchart for explaining error release processing when a conveyance error occurs in the medium feeding apparatus according to the modification of the first embodiment.

As shown in FIG. 6, the medium feeding apparatus 1 may not include the pick roller 61 and the medium detecting sensor 14*c*. In this case, it is preferable that the positions of the driving-side rollers and driven-side rollers of the separator 7 and the conveyor 8 in the up-and-down direction be reversed. That is, in the separator 7, the separating roller 71 is installed in the fixed unit 4 provided on the lower side and the braking roller 72 is installed in the rotating unit 3 provided on the upper side. Further, in the conveyor 8, the conveying roller 81 is installed in the fixed unit 4 provided on the lower side and the driven roller 82 is installed in the rotating unit 3 provided on the upper side.

Figure 7:
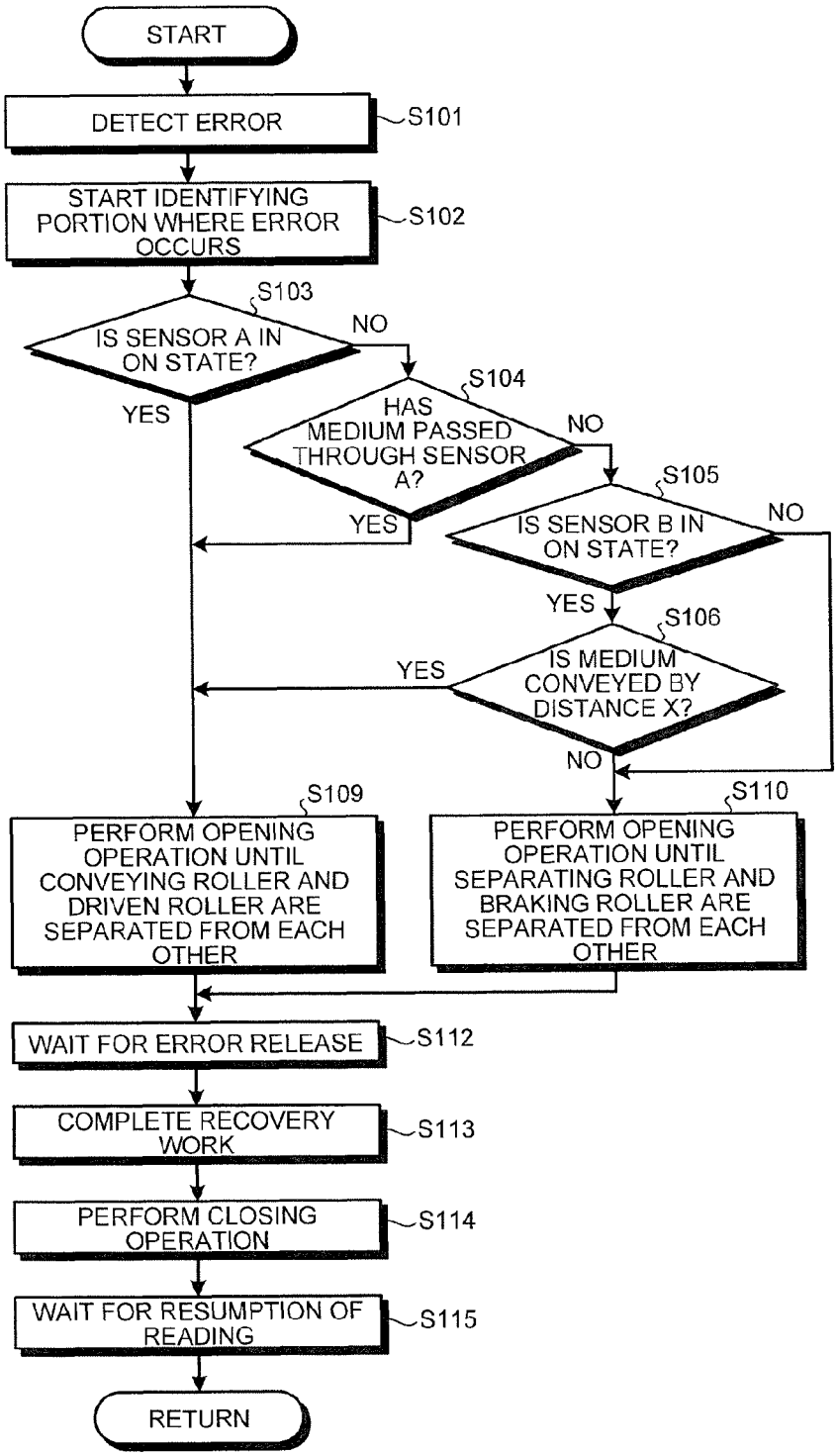
FIG. 7 is a flowchart for explaining error release processing when a conveyance error occurs in the medium feeding apparatus according to the modification of the first embodiment.

Since the medium detecting sensor 14*c* is not provided, the flowchart of the error release processing of this configuration is the same as shown in FIG. 7. In the flowchart shown in FIG. 7, Steps S107, S108, and S111 related with the medium detecting sensor 14*c* (sensor C) are eliminated from FIG. 4.

In the flowchart of FIG. 7, the process proceeds to Step S106 if the sensor B is in an ON state as a result of the determination of Step S105 (Yes in S105), and the process proceeds to Step S110 if the sensor B is in an OFF state (No in S105).

Second Embodiment

Figure 8:
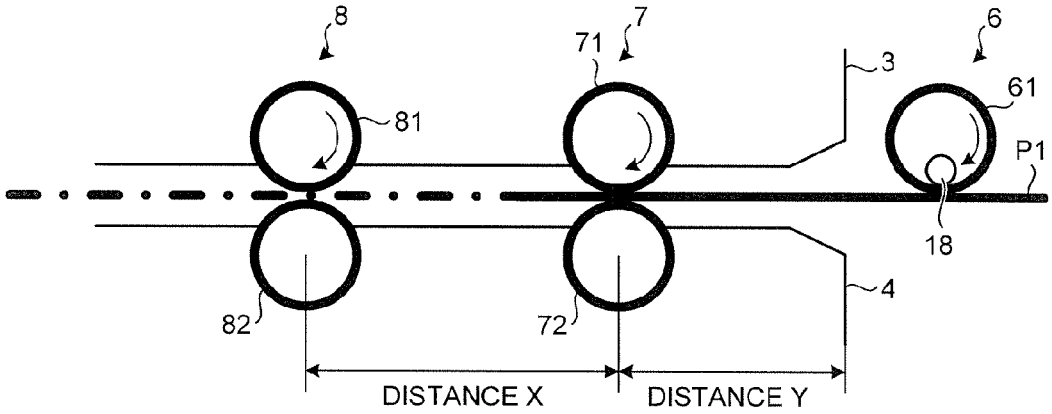
FIG. 8 is an enlarged schematic diagram of components provided near a conveying path of a medium feeding apparatus according to a second embodiment.
Figure 9:
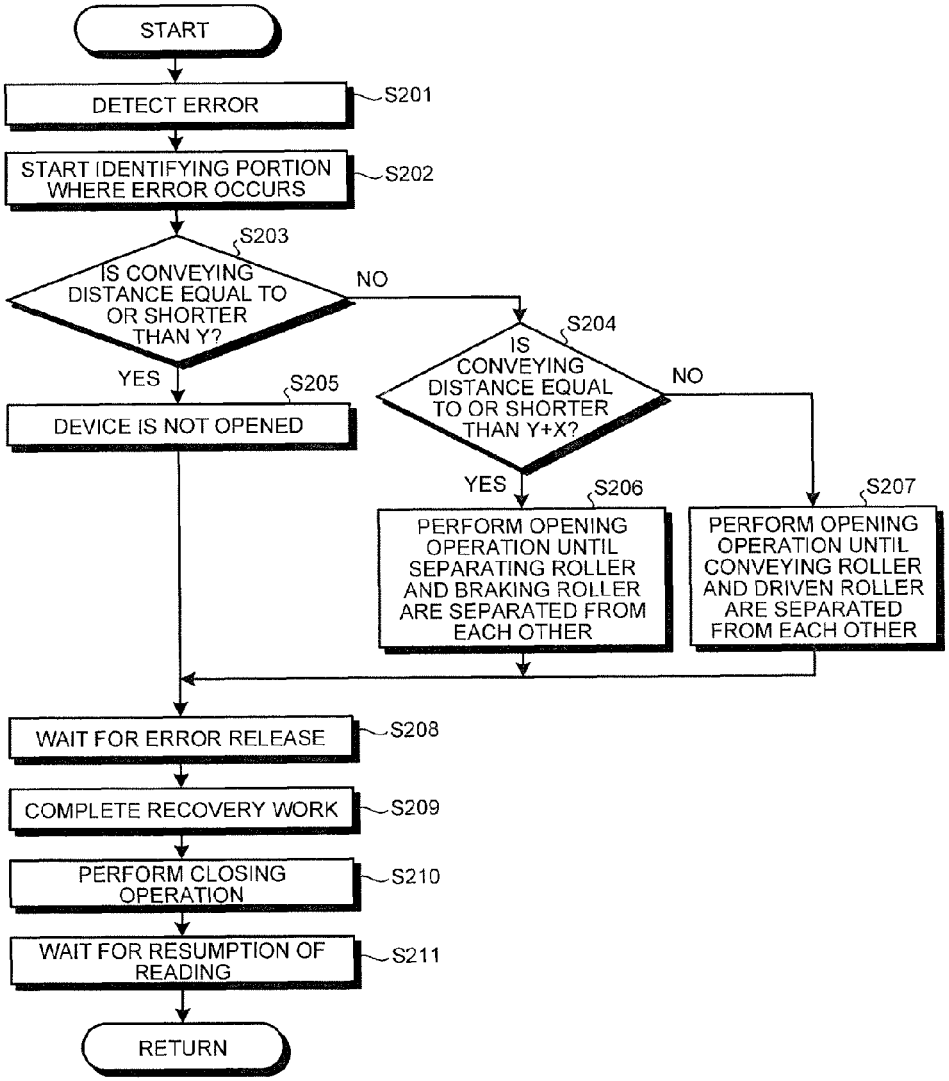
FIG. 9 is a flowchart for explaining error release processing when a conveyance error occurs in the medium feeding apparatus according to the second embodiment.

Next, a second embodiment will be explained with reference to FIGS. 8 and 9. FIG. 8 is an enlarged schematic diagram of components provided near a conveying path of a medium feeding apparatus according to a second embodiment, and FIG. 9 is a flowchart for explaining error release processing when a conveyance error occurs in the medium feeding apparatus according to the second embodiment.

A medium feeding apparatus 1 according to the second embodiment is different from the medium feeding apparatus according to the first embodiment in that a portion where a conveyance error occurs is specified according to a feeding distance of a medium from the hopper 2 at the time of the occurrence of a conveyance error. As shown in FIG. 8, the pick roller 61 is provided with an encoder 18 (measuring unit) and the feeding distance of the medium that is fed from the hopper 2 by the pick roller 61 is measured by the encoder 18.

The operation of the medium feeding apparatus 1 according to the second embodiment will be explained with reference to the flowchart of FIG. 9.

When a conveyance error is detected by an error detecting unit 22 (Step S201), processing for identifying a portion where the conveyance error occurs is started (Step S202). The error detecting unit 22 specifies the portion where the conveyance error occurs on the conveying path on the basis of a detection signal of the encoder 18. A process subsequently proceeds to Step S203.

It is determined in Step S203 whether the conveying distance of a medium measured by the encoder 18 is equal to or shorter than a predetermined distance Y. The distance Y is a distance between the hopper 2 and the separator 7 as shown in FIG. 8. That is, if the medium has been conveyed by a distance equal to or longer than the distance Y, the medium reaches the separator 7. If the conveying distance of the medium is equal to or shorter than the distance Y as a result of the determination of Step S203 (Yes in S203), the process proceeds to Step S205. If the conveying distance of the medium is equal to or longer than the distance Y (No in S203), the process proceeds to Step S204.

If it is determined in Step S203 that the conveying distance of the medium is equal to or longer than the distance Y, it is determined in Step S204 whether the conveying distance of the medium measured by the encoder 18 is equal to or shorter than a predetermined distance Y+X. As shown in FIG. 8, the distance X is a distance between the separator 7 and the conveyor 8. That is, if the medium is conveyed by a distance equal to or longer than the distance Y+X, the medium reaches the conveyor 8. If the conveying distance of the medium is equal to or shorter than the distance Y+X as a result of the determination of Step S204 (Yes in S204), the process proceeds to Step S206. If the conveying distance of the medium is equal to or longer than the distance Y+X (No in S204), the process proceeds to Step S207.

Since it can be determined in Step S205 that the medium is present on the feeder 6 or the downstream side of the feeder 6 as a result of the processing for identifying a portion where an error occurs performed by the error detecting unit 22, an opening operation is not performed by the error release operation control unit 23. The error release operation control unit 23 may inform an operator of a conveyance error, which occurs near the pick roller 61, through, for example, the display device 20*g* or the like. When the processing of Step S205 is completed, the process proceeds to Step S208.

Since it can be determined in Step S206 that the medium is present on the separator 7 or the downstream side of the separator 7 as a result of the processing for identifying a portion where an error occurs performed by the error detecting unit 22, an opening operation is performed by the error release operation control unit 23 so that the degree of opening becomes the degree of opening in which the separating roller 71 and the braking roller 72 of the separator 7 are separated from each other. When the processing of Step S206 is completed, the process proceeds to Step S208.

Since it can be determined in Step S207 that the medium is present on the conveyor 8 or the downstream side of the conveyor 8 as a result of the processing for identifying a portion where an error occurs performed by the error detecting unit 22, an opening operation is performed by the error release operation control unit 23 so that the degree of opening becomes the degree of opening in which the conveying roller 81 and the driven roller 82 of the conveyor 8 are separated from each other. When the processing of Step S207 is completed, the process proceeds to Step S208.

Since the processing of Steps S208 to S211 is the same as the processing of Steps S112 to S115 of the flowchart of FIG. 4 of the first embodiment, the redundant explanation will be omitted.

As explained above, in the medium feeding apparatus 1 according to the second embodiment, the error release operation control unit 23 of the controller 20 controls the opening unit so that the opening unit performs an opening operation to the degree of opening in which the conveying roller 81 and the driven roller 82 are separated from each other when the encoder 18 measures that a feeding distance of the medium from the hopper 2 at the time of the occurrence of an error is equal to or longer than the distance X+Y between the hopper 2 and the conveying roller 81 and the opening unit performs an opening operation until the separating roller 71 and the braking roller 72 are separated from each other when the encoder 18 measures that the feeding distance is equal to or longer than the distance Y between the hopper 2 and the separating roller 71 and shorter than the distance X+Y between the hopper 2 and the conveying roller 81.

According to this configuration, whether a medium causing a conveyance error reaches the conveyor 8 or reaches the separator 7 can be accurately identified, so that the degree of opening of an opening operation can be set appropriately. Accordingly, the efficiency of the recovery work at the time of the occurrence of a conveyance error can be further improved.

Further, in the medium feeding apparatus 1 according to the second embodiment, the error release operation control unit 23 of the controller 20 controls the opening unit so that the opening unit does not perform an opening operation when the encoder 18 measures that the feeding distance of a medium is shorter than the distance Y between the hopper 2 and the separating roller 71.

According to this configuration, whether a medium causing a conveyance error reaches the conveyor 8 or reaches the separator 7 or whether the medium is present on the upstream side of the separator 7 can be accurately identified, so that the degree of opening of an opening operation can be set appropriately. Accordingly, the efficiency of the recovery work at the time of the occurrence of a conveyance error can be further improved.

Third Embodiment

Figure 10:
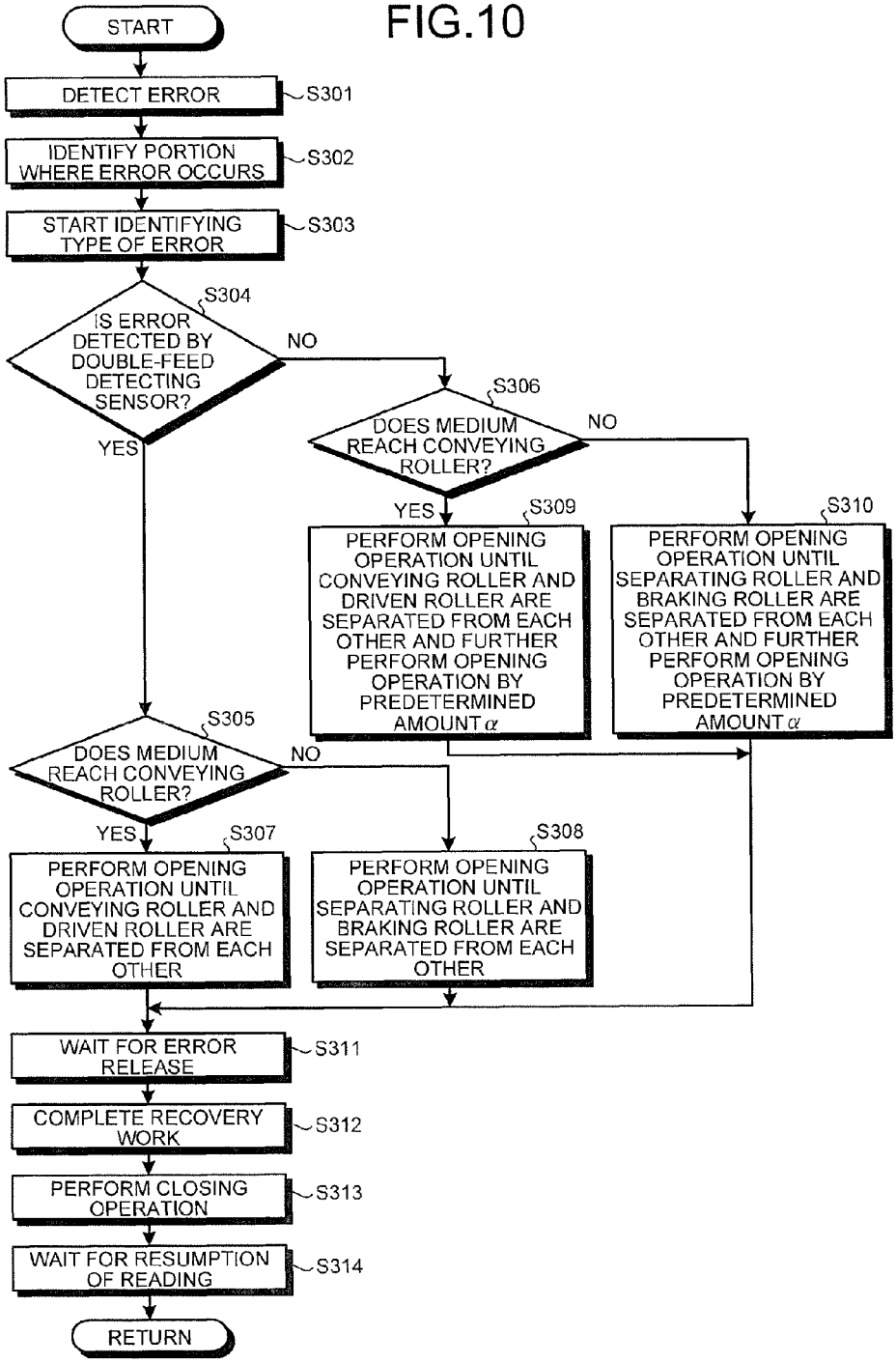
FIG. 10 is a flowchart for explaining error release processing when a conveyance error occurs in a medium feeding apparatus according to a third embodiment.

Next, a third embodiment will be explained with reference to FIG. 10. FIG. 10 is a flowchart for explaining error release processing when a conveyance error occurs in a medium feeding apparatus according to a third embodiment.

The medium feeding apparatus 1 according to the third embodiment is different from the medium feeding apparatus according to the first and second embodiments in that the degree of opening of an opening operation is identified according to the type of a conveyance error.

The operation of the medium feeding apparatus 1 according to the third embodiment will be explained with reference to the flowchart of FIG. 10.

When a conveyance error is detected by the error detecting unit 22 (Step S301), processing for identifying a portion where the conveyance error occurs is started (Step S302). The error detecting unit 22 specifies the portion where the conveyance error occurs on the conveying path by using the method of the first or the second embodiment. Then, processing for identifying the type of the conveyance error is started (Step S303). A process subsequently proceeds to Step S304.

It is determined in Step S304 whether the conveyance error detected in Step S301 is an error detected by a double-feed detecting sensor 15. If the conveyance error is an error detected by the double-feed detecting sensor 15 as a result of the determination of Step S304 (Yes in Step S304), it is determined that the type of this conveyance error is double-feed and the process proceeds to Step S305. Meanwhile, if the conveyance error is not the error detected by the double-feed detecting sensor 15 (No in Step S304), it is determined that the type of this conveyance error is not double-feed but a jam (paper jam) and the process proceeds to Step S306.

If it is determined in Step S304 that the conveyance error is detected by the double-feed detecting sensor 15, it is determined in Step S305 whether a medium reaches a conveying roller 81. The error detecting unit 22 determines whether the medium reaches the conveying roller 81, on the basis of the result of the specifying of a portion where an error occurs in Step S302. If the medium reaches the conveying roller 81 (Yes in Step S305), the process proceeds to Step S307. If the medium does not reach the conveying roller 81 (No in Step S305), the process proceeds to Step S308.

If it is determined in Step S304 that this conveyance error is not the error detected by the double-feed detecting sensor 15, it is determined in Step S306 whether a medium reaches the conveying roller 81. If the medium reaches the conveying roller 81 as a result of the determination of Step S306 (Yes in Step S306), the process proceeds to Step S309. If the medium does not reach the conveying roller 81 (No in Step S306), the process proceeds to Step S310.

Since it can be determined in Step S307 that the medium is present on the conveyor 8 or the downstream side of the conveyor 8 and the conveyance error is an error caused by double-feed as a result of the processing for identifying a portion where the conveyance error occurs and the type of the conveyance error performed by the error detecting unit 22, an opening operation is performed by the error release operation control unit 23 so that the degree of opening becomes the degree of opening in which the conveying roller 81 and the driven roller 82 of the conveyor 8 are separated from each other. When the processing of Step S307 is completed, the process proceeds to Step S311.

Since it can be determined in Step S308 that the medium is present on the separator 7 or the downstream side of the separator 7 and the conveyance error is an error caused by double-feed as a result of the identification of a portion where the conveyance error occurs and the type of the conveyance error performed by the error detecting unit 22, an opening operation is performed by the error release operation control unit 23 so that the degree of opening becomes the degree of opening in which the separating roller 71 and the braking roller 72 of the separator 7 are separated from each other. When the processing of Step S308 is completed, the process proceeds to Step S311.

Since it can be determined in Step S309 that the medium is present on the conveyor 8 or the downstream side of the conveyor 8 and the conveyance error is an error caused by a jam as a result of the identification of a portion where the conveyance error occurs and the type of the error performed by the error detecting unit 22, an opening operation is performed by the error release operation control unit 23 so that the degree of opening is further increased by a predetermined amount $\alpha$ in addition to the degree of opening in which the conveying roller 81 and the driven roller 82 of the conveyor 8 are separated from each other. When the processing of Step S309 is completed, the process proceeds to Step S311.

Since it can be determined in Step S310 that the medium is present on the separator 7 or the downstream side of the separator 7 and the conveyance error is an error caused by a jam as a result of the identification of a portion where the conveyance error occurs and the type of the error performed by the error detecting unit 22, an opening operation is performed by the error release operation control unit 23 so that the degree of opening is further increased by a predetermined amount $\alpha$ in addition to the degree of opening in which the separating roller 71 and the braking roller 72 of the separator 7 are separated from each other. When the processing of Step S310 is completed, the process proceeds to Step S311.

Since the processing of Steps S311 to S314 is the same as the processing of Steps S112 to S115 of the flowchart of FIG. 4 of the first embodiment, the redundant explanation will be omitted.

As explained above, in the medium feeding apparatus 1 according to the third embodiment, the error release operation control unit 23 controls the opening operation so that the degree of opening is increased by a predetermined amount, when the type of the conveyance error is a paper jam (jam). According to this configuration, the degree of opening of the opening operation can be identified according to the type of a conveyance error. Accordingly, the degree of opening of the opening operation can be more appropriately set.

The structure in which the separating roller 71 and the conveying roller 81 driven in the conveying direction are disposed in the rotating unit 3 and the braking roller 72 and the driven roller 82 are disposed in the fixed unit 4 has been exemplified in the embodiments, but these rollers may be disposed to the contrary. That is, the separating roller 71 and the conveying roller 81 may be disposed in the fixed unit 4, and the braking roller 72 and the driven roller 82 may be disposed in the rotating unit 3. Further, the separating roller 71 and the conveying roller 81 may be separately disposed in the rotating unit 3 and the fixed unit 4.

In the embodiments, a configuration that moves the lock shaft 11 in the up-and-down direction according to the movement of the hopper 2 has been exemplified as an opening/closing unit that automatically performs an operation for opening/closing the rotating unit 3 before and after recovery work at the time of the occurrence of a conveyance error of the medium P1. However, other configurations may be applied as long as the functions of the opening/closing unit can be obtained.

According to the medium feeding apparatus of the invention, time, which is taken for an opening operation and a recovery work, can be reduced, so that the efficiency of the recovery work at the time of the occurrence of a conveyance error can be improved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A medium feeding apparatus comprising:

a separating roller that feeds a medium in a conveying direction;

a braking unit that is disposed so as to come into press contact with the separating roller and applies a predetermined conveying load to the medium entering a gap between the separating roller and the braking unit;

a conveying roller that is disposed on a downstream side of the separating roller in the conveying direction;

a driven roller that is disposed so as to come into press contact with the conveying roller; and an opening unit that performs an opening operation in a direction in which members coming into press contact with each other on a conveying path for the medium are separated from each other when a conveyance error of the medium occurs, wherein the opening unit is configured to switch whether to perform a first opening operation to a degree of opening in which the conveying roller and the driven roller are separated from each other or to perform a second opening operation to a degree of opening in which the separating roller and the braking unit are separated from each other, according to an entering distance of the medium on the conveying path.

2. The medium feeding apparatus according to claim 1, further comprising:

a first medium detecting unit that is disposed on a downstream side of the conveying roller provided on the conveying path in the conveying direction and detects the medium; and a second medium detecting unit that is disposed between the separating roller and the conveying roller provided on the conveying path and detects the medium, wherein the opening unit is configured to perform the first opening operation to the degree of opening in which the conveying roller and the driven roller are separated from each other when the first medium detecting unit detects that the medium enters a gap between the conveying roller and the driven roller, and to perform the second opening operation to the degree of opening in which the separating roller and the braking unit are separated from each other when the second medium detecting unit detects that the medium enters the gap between the separating roller and the braking unit.

3. The medium feeding apparatus according to claim 2, further comprising:

a pick roller that is disposed on an upstream side of the separating roller in the conveying direction and sends the medium loaded on a medium loading unit to the downstream side; and a third medium detecting unit that is disposed between the pick roller and the separating roller provided on the conveying path and detects the medium, wherein the opening unit is configured to perform the second opening operation to the degree of opening in which the separating roller and the braking unit are separated from each other when the third medium detecting unit detects that the medium enters the gap between the separating roller and the braking unit, and configured not to perform the second opening operation when the third medium detecting unit detects that the medium does not enter the gap between the separating roller and the braking unit.

4. The medium feeding apparatus according to claim 1, further comprising:

a pick roller that is disposed on an upstream side of the separating roller in the conveying direction and sends the medium loaded on a medium loading unit to the downstream side; and a measuring unit that measures a feeding distance of the medium fed by the pick roller, wherein the opening unit is configured to perform the first opening operation to the degree of opening in which the conveying roller and the driven roller are separated from each other when the measuring unit measures that a feeding distance of the medium from the medium loading unit at the time of the occurrence of the conveyance error is equal to or longer than a distance between the medium loading unit and the conveying roller, and to perform the second opening operation until the separating roller and the braking unit are separated from each other when the measuring unit measures that the feeding distance is equal to or longer than a distance between the medium loading unit and the separating roller and shorter than the distance between the medium loading unit and the conveying roller.

5. The medium feeding apparatus according to claim 4, wherein the opening unit is configured not to perform the second opening operation when the measuring unit measures that the feeding distance is shorter than the distance between the medium loading unit and the separating roller.

6. The medium feeding apparatus according to any one of claim 1, wherein the opening unit is configured to increase the degree of opening by a predetermined amount when the type of the conveyance error defines a paper jam.

* * * * *